US005310040A

United States Patent [19]

Högen et al.

[11] Patent Number: 5,310,040

[45] Date of Patent: May 10, 1994

[54] PROCESS AND DEVICE FOR POSITIONING A BOBBIN

[75] Inventors: Bernhard Högen; Ludwig Braun, both of Ingolstadt; Ottmar Kovacs, Berching; Michael Ueding, Ingolstadt, all of Fed. Rep. of Germany

[73] Assignee: Rieter Ingolstadt Spinnereimaschinenbau AG, Ingolstadt, Fed. Rep. of Germany

[21] Appl. No.: 64,137

[22] PCT Filed: Apr. 30, 1992

[86] PCT No.: PCT/EP92/00950

§ 371 Date: May 21, 1993

§ 102(e) Date: May 21, 1993

[87] PCT Pub. No.: WO92/19519

PCT Pub. Date: Nov. 12, 1992

[51] Int. Cl.[5] ..... B65G 47/24

[52] U.S. Cl. ..... 198/409; 198/407; 198/464.1

[58] Field of Search ..... 198/406, 407, 409, 463.3, 198/464.1

[56] References Cited

U.S. PATENT DOCUMENTS

| | | | |
|---|---|---|---|
| 2,092,540 | 9/1937 | Talbot | 198/409 X |
| 2,725,137 | 11/1955 | Muddiman | 198/409 |
| 2,734,616 | 2/1956 | Schell et al. | 198/409 |
| 4,062,439 | 12/1977 | Kako et al. . | |
| 4,242,029 | 12/1980 | Musgrave | 198/407 X |
| 4,924,999 | 5/1990 | Kikuchi et al. . | |
| 4,940,127 | 7/1990 | Kikuchi et al. . | |
| 4,974,718 | 12/1990 | Raasch et al. | 198/406 |

FOREIGN PATENT DOCUMENTS

| | | | |
|---|---|---|---|
| 0124060 | 11/1984 | European Pat. Off. . | |
| 3742112 | 6/1988 | Fed. Rep. of Germany . | |
| 3742220 | 4/1989 | Fed. Rep. of Germany . | |
| 3912683A1 | 11/1989 | Fed. Rep. of Germany . | |
| 0028113 | 3/1981 | Japan | 198/406 |
| 0835908 | 6/1981 | U.S.S.R. | 198/407 |

OTHER PUBLICATIONS

German Search Report.
European Search Report.
Article—VDI-Nachrich, Oct. 30, 1987, p. 36 FF.

*Primary Examiner*—James R. Bidwell
*Attorney, Agent, or Firm*—Dority & Manning

[57] ABSTRACT

A process and a device is provided for the positioning of bobbins which are delivered by a conveying device and are tilted from a conveyed position into a position from which they can be picked up by a grasper. Provisions are made for the bobbins to be brought into the desired position for pickup by the grasper. For this, further provisions are made for the tilting action to be triggered by the bobbin which is running up against a tilting surface and for the bobbin to be brought up against a stop so that the predetermined position is achieved.

28 Claims, 4 Drawing Sheets

PROCESS AND DEVICE FOR POSITIONING A BOBBIN

BACKGROUND OF THE INVENTION

The present invention relates a process and a device for the positioning of a bobbin which is delivered by a conveying device, wherein the bobbin is tilted from the conveyed position into a position suitable for pick-up by a grasper.

Modern spinning machines are normally provided with conveying devices which receive the bobbins of yarn produced on these machines to store them in intermediary storage and remove them to the packing station. Customarily, yarn bobbins are packed on pallets for shipment in such a manner that the bobbins are placed on the pallet with their axes in upright position in order to protect the layers of yarn. The bobbins which arrive from their winding stations with the bobbin axis in horizontal position must be repositioned in order to be palletized, and must be conveyed from the machine to the pallet with the yarn layers being touched as little as possible.

An automatic handling apparatus with six axles for automatic bobbin removal on a rotor spinning machine (VDI-Nachrichten No. 44; Oct. 30, 1987 page 36 ff.) This machine recognizes the bobbin and its orientation at the end of the conveyor belt of a rotor spinning machine (which ejects the bobbin), grasps it with an electronically controlled grasper, and transfers it under electronic control to a bobbin-conveying carriage. This device is extremely expensive and involves high costs because of the use of a robot controlled via six axles.

A system is also known in which the bobbins are processed by means of palletizing systems and the machine is emptied of bobbins in a fully automatic manner. In order to bring the produced bobbins to the predefined location on the pallet, it is necessary to known its exact bobbin position, or the position of the bobbin axis, so as to be able to grasp and transport the bobbin by means of the automatic handling device without damaging it. For this purpose, the bobbins with a horizontal bobbin axis are delivered by the conveyor belt of the spinning machine to the end of the machine with the "Pally" system, and are picked up by the "Pally" palletizing system. When the palletizing system has taken up its position at the end of the conveyor belt, the bobbins are tilted on two parallel conveyor belts. In this case, the tube protruding at the front of the bobbin lies between the belts which support the bobbin on its front side. These parallel belts convey the tilted bobbins to the desired position below a grasping device so that the latter is able to pick up the bobbins in order to place them on a pallet. This arrangement requires much space and is relatively complicated. Electronically controlled search and positioning devices are required so that the pick-up device is able to adjust itself on each spinning machine to the corresponding bobbin size or to the appertaining gap pattern of the intermediate layers.

A device is also known from DE 39 12 683 A1 which consists of a tilting element 25 and a linked positioning conveyor belt 26 as well as of a centering device 35. This tilting element serves to orient the axis of the bobbin vertically by rotating it by 90°. It operates above a horizontal positioning belt conveyor which is designed so that it transfers the bobbins to this positioning belt conveyor 26 after their tilting movement has been executed, to be then transferred by the latter to a centering device which assures the precise positioning of each bobbin so that a grasper 47 may grasp the bobbin and convey it to a loading plane. Three devices, i.e. the tilting device, the positioning, and the centering device, are provided for this arrangement in order to tilt a bobbin and to bring it into a position which is provided for pick-up by a grasper. This arrangement is also relatively complicated and expensive. There furthermore exists the danger that the windings may be damaged at the bobbin's circumference when it is being centered.

OBJECTS AND SUMMARY OF THE INVENTION

It is a principal object of the present invention to avoid the disadvantages of the state of the art and to create a process and a device to place the bobbins delivered by a conveyor belt into a defined position in a simple, reliable and space-saving manner so that they may be removed from this position by a grasping device.

Additional objects and advantages of the invention will be set forth in part in the description which follows, and in part will be obvious from the description, or may be learned by practice of the invention. According to the present invention, as they are tilted, the bobbins are brought through the tilting motion into the desired position. The great advantage of this solution lies in the fact that the two actions, i.e. bobbin tilting and bobbin centering, are superimposed on each other, or combined, and are controlled by a common device with respect to drive. This has the advantage that only one drive is required and that the combined device requires very little space. It is also a great advantage that, contrary to the present state of the art, no additional time is required to position the bobbin, since this positioning takes place during the tilting process, which occurs in any case.

The tilting process is preferably initiated by the bobbin which is delivered by the conveying device, and not by external sensors or switching devices. This advantageous direct control, requiring no intermediary elements, ensures that the tilting device does not start tilting before a bobbin is present. It is advantageous to allow the tilting process to first start up and continue until the bobbin lies on the tilting device in stable equilibrium, and only then to start the positioning process. The bobbin is then not only tilted in a simple manner, but is also positioned at the same time. The bobbin is thus also handled with care without damage being caused to the yarn.

Through practice of the invention, it is especially advantageous to bring the bobbins into the desired position independently of their diameter or conicity. The conventional difficulty involved in having to handle bobbins of different diameters which are delivered by the machine does not exist at all with the present invention, as the bobbins are positioned by using the bobbin tube so that a clear positioning of the bobbin center is achieved easily and in all instances.

It is advantageous to provide the positioning and the tilting devices with a common drive, and it is furthermore advantageous to install two tilting/positioning devices in parallel position and to provide these also with a common drive. The drive is advantageously a pneumatic drive. This arrangement is superior to an electric motor or hydraulic drive because of the ease of pneumatic energy supply. However, such electric or hydraulic drives may also be used. The positioning device is also advantageously provided with only one movable stop. This stop can slide in a longitudinal movement and, contrary to conventional other sliding stops which sometimes move along complicated paths, it is simple and reliable in its operation. Other advantageous embodiments of the invention are described in the following description.

The figures show an embodiment of the invention which is described in greater detail below and constitute a part of this specification and, together with the description, serve to explain the principles of.

DETAILED DESCRIPTION OF THE PREFERRED EMBODIMENTS

Figure 1:
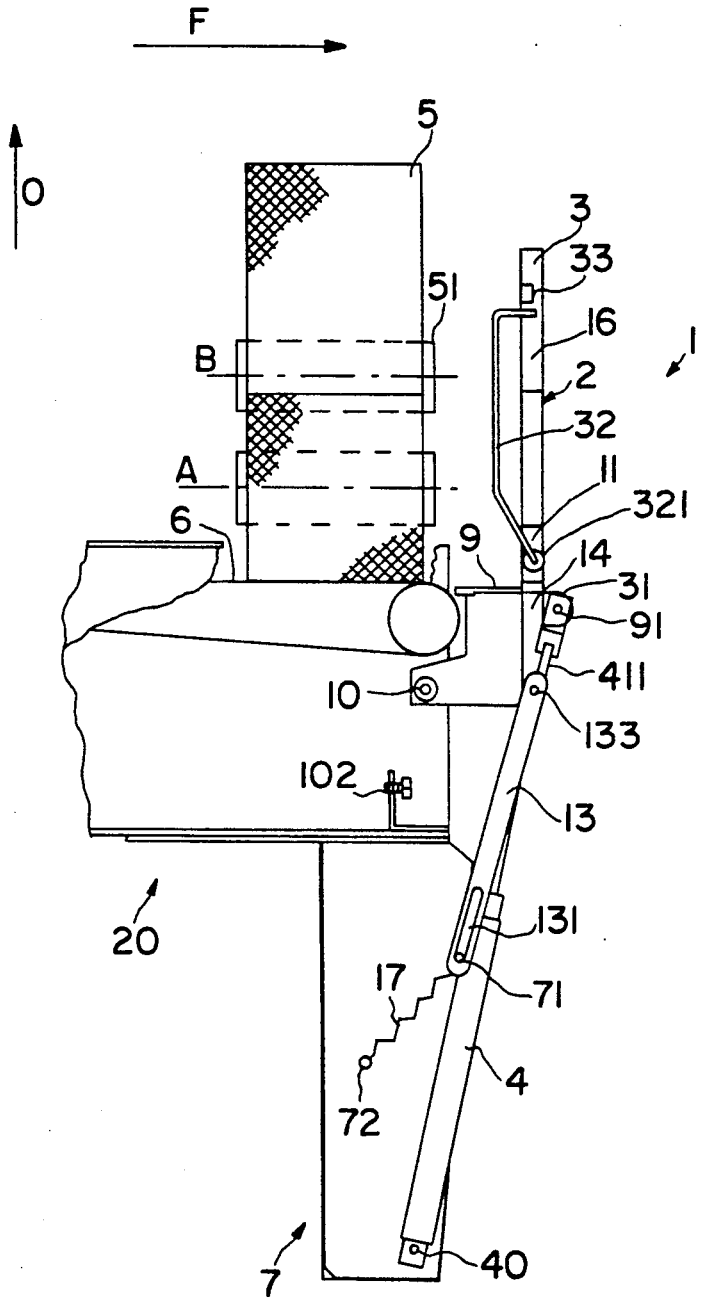
FIG. 1 shows a side view of a device according to the invention before the bobbin is tilted.

Reference will now be made in detail to the presently preferred embodiments of the invention, one or more examples of which are illustrated in the accompanying drawings. Each example is provided by way of explanation of the invention, not limitation of the invention. The numbering of components in the drawings is consistent throughout the application, with the same components having same number in each of the drawings.

Figure 3:
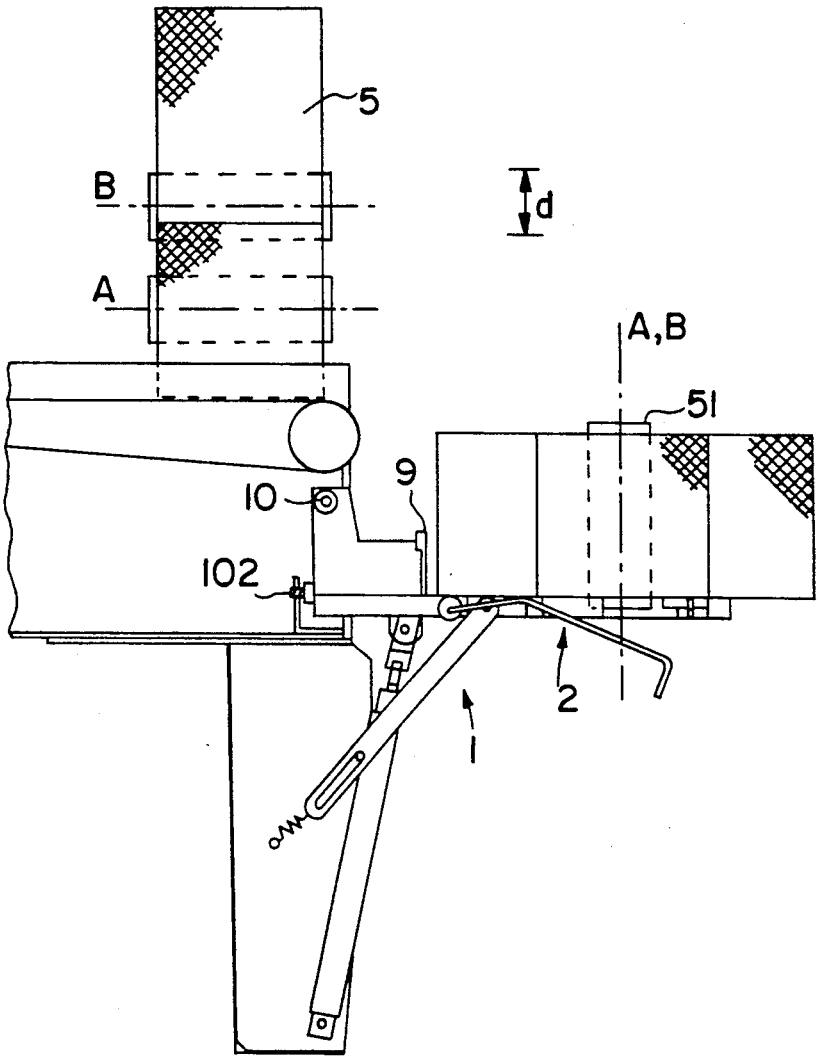
FIG. 3 shows a side view of the device after the bobbin has been tilted.

FIG. 1 shows an embodiment of the device according to the invention before the tilting of a bobbin 5 in a state shortly before the bobbin 5 leaves a conveyor belt 6 and is placed on the supporting plate 9 of a tilting device 1. The supporting plate 9 may be given a slight rise on the side in order to pre-center the bobbin 5, so that its bobbin tube 51 may be introduced securely into a positioning device 2. The tilting device 1 is shown here in an embodiment that is added on at the end of a conveying device. This conveying device contains the conveyor belt 6 on which cross-wound bobbins in different sizes are dropped off by a device which is not shown here, and are conveyed by the conveyor belt 6 to the end of the conveyor belt (in this example to the right), to be tilted and positioned by the tilting device 1, so that the bobbin (in a position as shown in FIG. 3) may be taken up by a handling device coming from above. Two different bobbin sizes are shown here, i.e. a small bobbin with bobbin axis "A", and a large bobbin with bobbin axis "B". The bobbins are conveyed by the conveyor belt 6 in direction "F" (directional arrow "F") against a plate 3 of the tilting device.

Plate 3 of the tilting device 1 can be rotated around a substantially horizontal rotational axis 10. Supporting plate 9 is attached at substantially a right angle to plate 3 approximately at the level of conveyor belt 6 and continues into a lever arm 31 at the coupling point 91 of which the piston rod 411 of a piston 41 is articulately supported. Piston 41 is the movable part of a pneumatic cylinder 4 which is articulately supported by its cylinder end in a fixed bearing point 40. The elements of the arrangement are thus advantageously coordinated with each other so that when the piston 41 moves the piston rod 411 in a downward direction in cylinder 4, it tilts plate 3 around axis 10 (in this figure) in a clockwise direction so that plate 3 comes to rest in a substantially horizontal position by being brought up against an adjustable stop 102 which is immovably mounted at the end of the conveyor belt. The position of tilted plate 3 is then as indicated in FIG. 3. The piston rod 411 of the pneumatic cylinder 4 is articulately mounted in the coupling point 91 of the lever arm 31. A stop 14 which is able to slide in guide 15 is provided in the swivelling plate 3. This sliding stop 14 has an axle 133 on which a connecting rod is articulately mounted. Stop 14 is able to slide freely between a stopping edge 141 and the fixed stop 16 which is located in plate 3. At its end across from the coupling point 91, the connecting rod 13 is provided with a slot 131 which is traversed by a pin 71 which is fixedly attached in the holding device 7. Furthermore a spring 17 is attached to the connecting rod 13 and pulls the connecting rod 13 in the direction of the attachment point 72 of spring 17 which is mounted on the holding device 7, insofar as it is able to move in the area of the slot 131 due to the tilting movement of plate 3. A projection 11 is linked to the sliding stop 14 and is capable of sliding across from sliding stop 14 and can be pushed away from stop 14 by same via spring elements 111. If the sliding stop 14 now moves in direction of arrow "O", the projection 11 can move elastically against stop 14 if it does not encounter any obstacle. In this manner the bobbin tube 51 extending above the bobbin surface and lying on the tilting device is grasped by the positioning device 2 and is positioned. Positioning takes place independently of the existing bobbin diameter, since it takes place exclusively as a function of the bobbin tube 51. The removal of bobbin 5 by a grasper is thus facilitated considerably, since the bobbin center is always in the same position for identical bobbin tube diameters.

A hoop 32 is mounted in plate 3 and can be rotated around a rotational axis 321. This hoop is pressed in the direction of the conveyor belt by a coiled spring 321 which bears upon the plate 3, and is stopped at a stopping edge 331 of switch 33. Switch 33, which is installed on plate 3, is made in form of an inductive switch in this case, with the triggering of the switching impulse depending on whether a metallic object is present or not in front of the switch. In the example shown, this metallic object is the transversal rod 322.

The hoop is a double hoop which has essentially the form of an inverted "U". In the state in which no bobbin presses against plate 3, the transversal rod 322 of the hoop (FIG. 4) lies in the area of switch 33 in which said switch 33 is influenced. Removal of the transversal rod 322 of the hoop from this area causes switch 33, made in form of an induction switch, transmits a switching impulse to controls 18 (not shown) of the device in order to initiate the tilting process.

The process and operation of the device: Conveyor belt 6 moves in the direction of arrow "F" and conveys a bobbin 5 to the tilting device 1. The bobbin 5 leaves the conveyor belt 6 and reaches supporting plate 9, pushed there by the effect of the conveyor belt 6. Bobbin 5 pushes the hoop 33 in the direction of plate 33, so that hoop 3 rotates around axis 321 and avoids the bobbin 5. As a result, the transversal piece 322 of the hoop is moved outside the active range of switch 33 and thereby causes the drive of the conveyor belt 6 to be switched off. At the same time switch 33 operates a solenoid valve (not shown) which exerts pressure upon the pneumatic cylinder 4 in such manner that the piston rod 411 moves into the cylinder of the pneumatic cylinder 4. Since the piston rod 411, at coupling point 91, is coupled with the lever arm 31 of plate 3, the movement of the piston rod 411 causes plate 3 to tilt around rotational axis 10. This causes, at the same time, a rotation of the coupling point 133 of connecting rod 13 on the tilting device 1. Connecting rod 13 moves as a result of gravity and assisted by spring 17, which is mounted in the attachment point 72 on holding device 7, and engages on the other side at the slotted end of connecting rod 13 in such manner that coupling point 133 of the connecting rod is rotated around a rotational axis in the horizontal plane of axis 10 while the other end of the connecting rod 13 is at the same time turned and swivelled by the pin 71 "running" in slot 131 until the "upper" end of the slot is reached by pin 71. From that moment on the connecting rod 13 is only rotated around an axis in the horizontal plane of fixed pin 91, causing the sliding stop 14 coupled to connecting rod 13 and which slides in plate 3 to move in direction of the fixed stop 16 and to push the end of bobbin tube 51 of the bobbin which extends into the path of the sliding stop 14, and thereby bobbin 5 itself, in the direction of stop 16. The device is adjusted so that when the rotation of plate 3 around rotational axis 10 is completed, i.e. the position in which plate 3 is in contact with stop 102, the bobbin tube 51 of bobbin 5 is displaced precisely so far that it is firmly pressed against the V-shaped stop 16 and against the V-shaped projection of the sliding stop 14 and is thus in a defined position. (FIG. 3 shows this position). It is, however, necessary for this adjustment to be clearly based on a bobbin tube diameter. This is however not difficult as a rule, since the bobbin tubes are generally standardized. Even if the bobbin tube has a conical shape, it is correctly positioned and centered between the two stops 14 and 16, on the condition that the larger bobbin diameter was oriented in the direction of the tilting device.

Subsequently a grasper (not shown) coming from above grasps the bobbin by its bobbin tube 51 and removes the bobbin 5 from plate 3 in its upward movement, as is understood by those skilled in the art. This action in turn causes the hoop 32 to spring back so that it is again pushed with its transversal rod 322 within active range of switch 33 and so that controls (not shown) are informed that a bobbin is no longer lying on plate 3. At this point, controlled via a time function element or an optical scanner, the solenoid gives the switching impulse to put the pneumatic cylinder 4 once more under pressure so that the piston rod 411 is again extended and plate 3 of the tilting device is moved back into its original, vertical position. At the same time the connecting rod 13 is necessarily moved upward again, and due to the forced guidance by slot 131 which remains caught on pin 71 as of a certain point in time, the sliding stop 14 is necessarily again moved away from the fixed stop 16, thus creating the condition for a bobbin tube 51 of a new bobbin to be able to "plunge" without difficulty between the two stops, so that the same tilting process can start again from the beginning.

Figure 2:
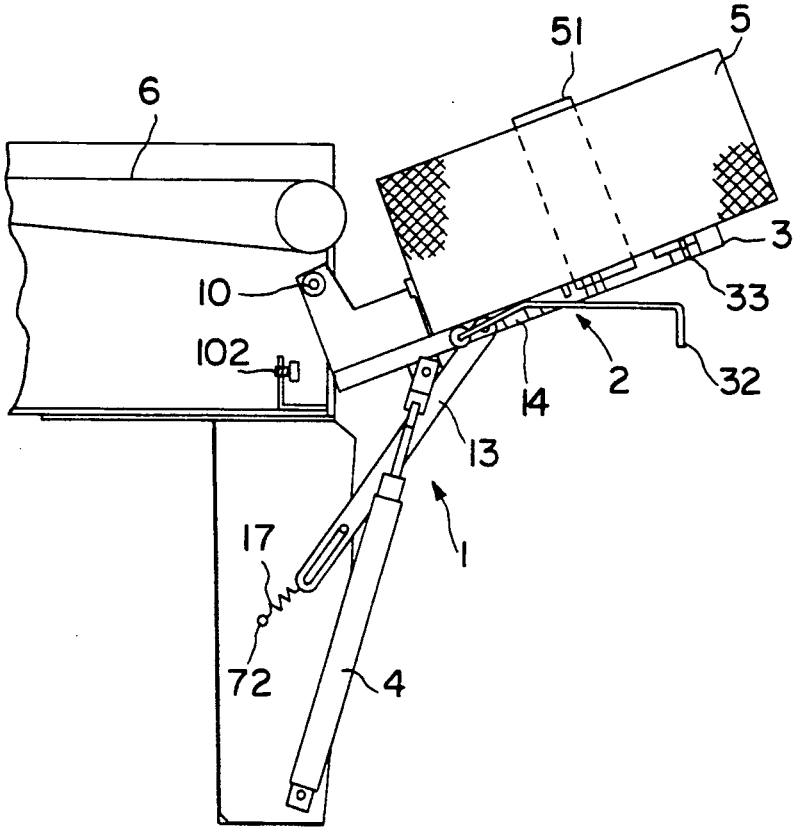
FIG. 2 shows a side view of the device during tilting.

FIG. 2 shows the tilting device in the situation in which plate 3 is swivelled around rotational axis 10 until sliding stop 14 engages at the bobbin tube 51 of bobbin 5. In this position the positioning process begins through the shifting of plate 3 during tilting from the vertical into the horizontal position.

FIG. 3 shows the position already described above, in which the bobbin is positioned and is ready for pick-up by a grasper from a position designed for grasper pick-up. The axes A and B of the small and the large bobbin which were one above the other before tilting are now at the same location. Bobbin 5 is pushed away by the displacement of stop 14 from supporting plate 9 in the direction of fixed stop 16.

Figure 4:
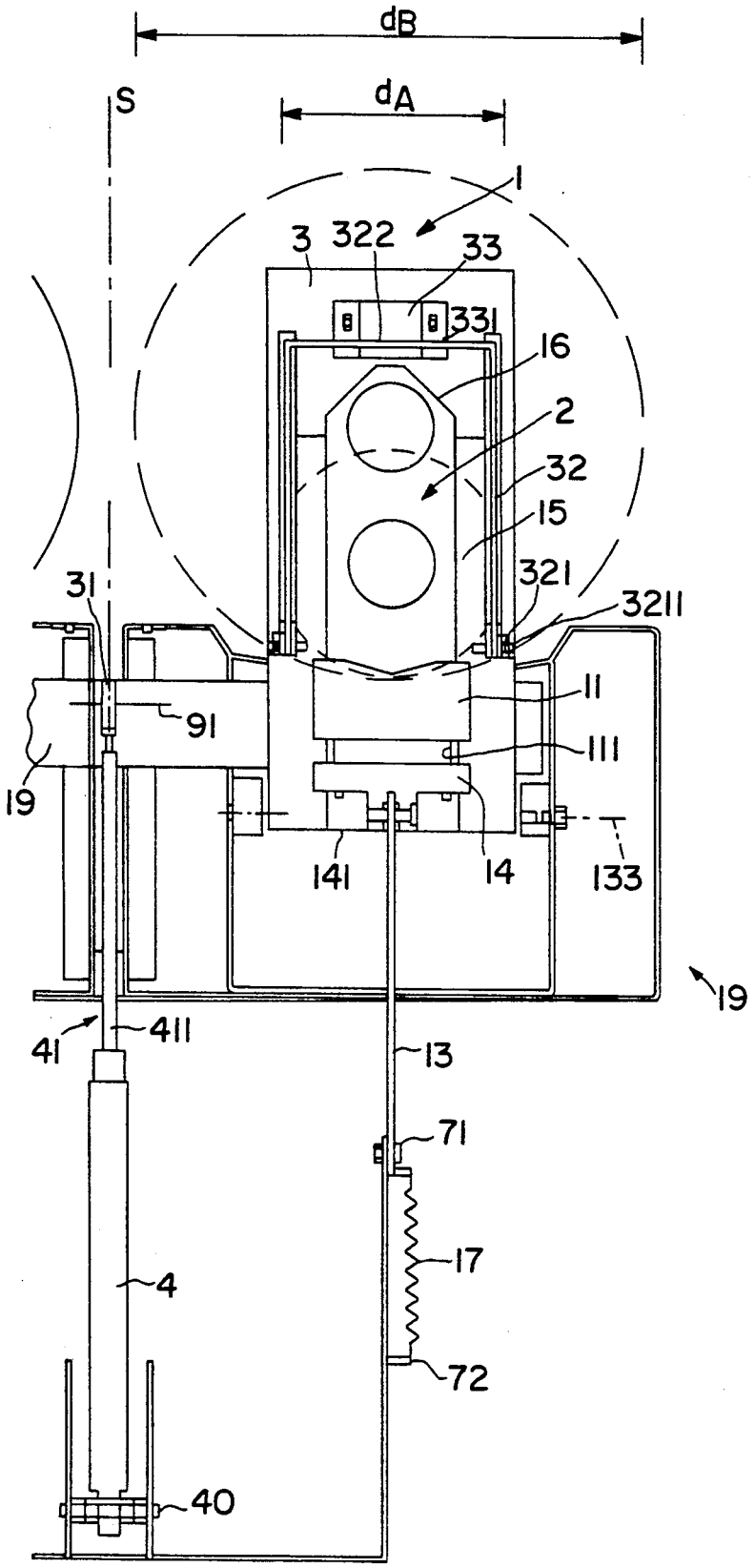
FIG. 4 shows a frontal view of the device before tilting.

FIG. 4 shows an embodiment according to the device which is attached to a double conveyor belt, whereby only one pneumatic cylinder 4 is advantageously required for two plates 3. For reasons of available space and clarity, the device is not shown completely. It should be imagined as a mirror image at the symmetrical axis "S". The two plates 3 are connected to each other by a connecting plate 19, whereby the coupling point 91 of the lever arm 31 of plate 3 is offset out of plate 3, exactly in the center between the two plates 3. In this manner it is possible to use only one cylinder 4, i.e. one for the plate 3 to be tilted which is in use at that moment. It is advantageous for the loading and unloading cycle of the conveyor belts to be adjusted so that one conveyor belt is loaded with bobbins by a device which is not shown and remains immobile, while the other conveyor belt is unloaded in that the bobbins are brought to the end of the conveyor belt, are tilted, positioned and removed. It is also possible to equip this device for three and more conveyor belts installed one next to the other with only one pneumatic cylinder which would possibly have to be somewhat stronger in order to compensate for the empty weight of the device.

This multiple arrangement of plates 3 on one tilting device can of course also be used directly on the bobbin conveyor belt of a bobbin-producing machine. Instead of a pneumatic cylinder, a worm gear drive or toothed-wheel/toothed rod drive can be used at this point. The switching and control device via hoop 32 and switch 33 can also be replaced by conventional switches and/or sensors. It is also possible for hoop 32 to actuate a pneumatic valve directly to control the pneumatic cylinder 4. The impulse triggering the tilting process can also be initiated by an indirect control system, which could, for instance, ascertain the position of the bobbin delivered on conveyor belt 6 at the location which is relevant for tilting. Connecting rod 13 can also be made without a slot by providing only a bore through which the pin 71 is inserted at the end of the connecting rod instead of the slot. It is then however no longer possible to tilt all the different bobbin sizes delivered by the conveyor belt securely and precisely between the stops in an "open" position. The width range of the different bobbin diameters that could be processed would be considerably smaller. FIG. 4 shows also the arrangement of stop 11 which is connected elastically via pins 142 and spring element to the sliding stop 14. Projection 11 and stop 14 can for instance run in guides 15 of a spring/groove or some other interlocking design. FIG. 4 also clearly shows the diameter range within which the bobbins can be processed without having to provide the tilting device with any special or costly devices. The range of bobbin diameters capable of being processed lies in this case between $d_A$ and $d_B$.

The invention is not limited to the embodiments shown. It is thus also possible to install the device according to the invention in travelling palettizing or packing devices which travel to the conveyor belt to be unloaded and carry out the unloading process, instead of in a fixed position at conveyor belts or similar devices.

It will be apparent to those skilled in the art that various modifications and variations can be made in the present invention without departing from the scope or spirit of the invention.

We claim:

1. A process for positioning textile bobbins delivered by a conveying device for subsequent grasping by a grasping device, said process comprising the steps of:

delivering the bobbin to a tilting device with the conveying device, the axis of the bobbin oriented substantially horizontal with respect to the conveying device;

supporting the bobbin in its horizontal position upon a support surface of the tilting device;

actuating the tilting device so that the bobbin is tilted approximately 90 degrees, wherein the bobbin axis is substantially vertical;

substantially simultaneously with said tilting, positioning the bobbin on the tilting device so that the bobbin axis is essentially placed at a relatively constant position with respect to the tilting device regardless of the diameter of the bobbin, bobbins of varying diameters thus being positioned at the relatively same position for suitable grasping by a grasping device.

2. The process as in claim 1, further comprising initiating said tilting process by sensing the presence of the bobbin at the tilting device.

3. The process as in claim 2, further comprising causing the bobbin to actuate a switch device at the tilting device for initiating said tilting process.

4. The process as in claim 1, wherein said positioning process includes moving the bobbin along the tilting device by means of engaging a portion of the bobbin tube extending from the bobbin.

5. The process as in claim 1, wherein said positioning process begins only after said tilting process is initiated.

6. The process as in claim 1, wherein said positioning process includes securing the bobbin in position against at least one stop mechanism.

7. The process as in claim 6, further including securing a portion of the bobbin tube extending from the end of the bobbin between two stops of the tilting device, at least one of the stops being movable relative to the other of the stops.

8. A device for positioning textile bobbins formed about a bobbin tube which are delivered from a conveying device with their axis oriented substantially horizontal to a position wherein their axis is substantially vertical for subsequent grasping by a grasping device, said device comprising:

a tilting device, said tilting device including a support surface for receiving the bobbin from said conveying device in a substantially horizontal position;

drive means for rotating said tilting device so that a bobbin carried thereby is tilted approximately 90 degrees to a substantially vertical position; and a positioning device configured integral with said tilting device, said positioning device further comprising means which operate substantially simultaneously with said tilting device for positioning bobbins in their vertical position so that the bobbin axis of bobbins with different outside diameters are at a relatively fixed predetermined position on said tilting device regardless of the diameter of the bobbins for subsequent pick-up by a grasping device.

9. The device as in claim 8, wherein said positioning means includes at least two stops defining a varying opening for receiving the bobbin tube extending from said bobbins, at least one of said stops being movable relative to the other of said stops, said stops cooperating to position said bobbin at said fixed predetermined position by engaging and moving said bobbin by way of its bobbin tube.

10. The device as in claim 9, wherein said tilting device comprises a first support plate for receiving said bobbin from said conveying device, and a second support plate oriented substantially perpendicular to said first support plate, said stops being movable relative each other along said second support plate.

11. The device as in claim 8, wherein said tilting device further comprising a switching device for actuating said tilting device.

12. The device as in claim 11, wherein said switching device is actuated by a bobbin reaching a predetermined position relative said tilting device.

13. The device as in claim 12, wherein said switching device is a proximity sensing device.

14. The device as in claim 13, wherein said switching device is a contact switching device.

15. The device as in claim 8, wherein said tilting device and said positioning device share at least in part a common drive mechanism.

16. The device as in claim 15, wherein said positioning device is driven at least in part by movement of said tilting device.

17. The device as in claim 8, wherein said tilting device includes a support plate which is rotatable about a horizontal axis, and a lever arm operably connected to said support plate, said tilting device drive means connected to said lever arm for causing said support plate to rotate about said horizontal axis.

18. The device as in claim 17, wherein said tilting device drive means includes a pneumatic drive mechanism, said pneumatic drive mechanism including a piston rod hinged to said lever arm.

19. The device as in claim 8, wherein said tilting device drive means comprises a pneumatic drive mechanism which includes a pneumatic cylinder rotatably mounted at one end thereof, said pneumatic cylinder further comprising a piston rod hinged to said tilting device.

20. The device as in claim 19, wherein said tilting device further includes a switch for actuating said pneumatic drive mechanism.

21. The device as in claim 20, wherein said switch is a solenoid valve through which said pneumatic cylinder is controlled.

22. The device as in claim 20, wherein said tilting device further comprises a hoop disposed to be contacted and displaced by a bobbin carried by said tilting device, said hoop actuating said switch.

23. The device as in claim 8, wherein said positioning means comprises a first stop which is slidably mounted on said tilting device, and a second stop which is fixedly mounted on said tilting device, said stops defining a varying opening for receiving said bobbins and positioning said bobbins at said relatively fixed predetermined position on said tilting device.

24. The device as in claim 23, further comprising a connecting rod connected at one end thereof to said sliding stop and rotatably mounted at the other end thereof at a fixed bearing point.

25. The device as in claim 24, wherein said connecting rod comprises a slot defined in the end thereof connected to said fixed bearing point, said fixed bearing point including a pin engaging said slot.

26. The device as in claim 23, wherein the maximum distance between said slots is a multiple of the diameter of a bobbin tube.

27. The device as in claim 23, wherein said stops are essentially V-shaped.

28. The device as in claim 23, wherein said sliding stop is also connected to an elastic projection device.

* * * * *